US009303921B2

(12) United States Patent
Berner

(10) Patent No.: US 9,303,921 B2
(45) Date of Patent: Apr. 5, 2016

(54) OXIDATION FURNACE

(75) Inventor: Karl Berner, Altdorf (DE)

(73) Assignee: EISENMANN AG, Boeblingen (DE)

( * ) Notice: Subject to any disclaimer, the term of this patent is extended or adjusted under 35 U.S.C. 154(b) by 275 days.

(21) Appl. No.: 13/820,390

(22) PCT Filed: Aug. 16, 2011

(86) PCT No.: PCT/EP2011/004108

§ 371 (c)(1),
(2), (4) Date: Mar. 1, 2013

(87) PCT Pub. No.: WO2012/028260

PCT Pub. Date: Mar. 8, 2012

(65) Prior Publication Data

US 2013/0171578 A1 Jul. 4, 2013

(30) Foreign Application Priority Data

Sep. 3, 2010 (DE) ..... 10 2010 044 296

(51) Int. Cl.

| | |
|---|---|
| ***F27B 9/28*** | (2006.01) |
| ***F27D 7/04*** | (2006.01) |
| ***D01F 9/32*** | (2006.01) |
| ***F27B 9/30*** | (2006.01) |

(52) U.S. Cl.

CPC .. *F27D 7/04* (2013.01); *D01F 9/32* (2013.01); *F27B 9/28* (2013.01); *F27B 9/3005* (2013.01)

(58) Field of Classification Search

CPC ..... C21D 9/00; C21D 9/56; C21D 9/5732; F27B 9/28; F27B 9/36; F27B 9/10; B29B 13/023

USPC ..... 432/8, 59; 34/634, 224, 236, 635, 643, 34/638, 637, 618; 264/210.7, 290.2, 165, 264/289.3

See application file for complete search history.

(56) References Cited

U.S. PATENT DOCUMENTS

| | | | | |
|---|---|---|---|---|
| 4,515,561 | A * | 5/1985 | Melgaard | 432/136 |
| 4,559,010 | A * | 12/1985 | Katsuki et al. | 432/59 |
| 5,908,290 | A * | 6/1999 | Kawamura et al. | 432/59 |
| 6,027,337 | A * | 2/2000 | Rogers et al. | 432/64 |
| 6,776,611 | B1 * | 8/2004 | Sprague | 432/64 |
| 7,004,753 | B2 * | 2/2006 | Stockhausen | 432/59 |
| 7,335,018 | B2 * | 2/2008 | Yamaguchi | 432/59 |
| 2005/0115103 | A1 * | 6/2005 | Yamaguchi | 34/580 |

FOREIGN PATENT DOCUMENTS

| | | |
|---|---|---|
| JP | 59137510 | 8/1984 |
| JP | 2007247130 | 9/2007 |
| JP | 2010002176 | 1/2010 |

* cited by examiner

*Primary Examiner* — Gregory A Wilson

(74) *Attorney, Agent, or Firm* — Factor Intellectual Property Law Group, Ltd.

(57) ABSTRACT

An oxidation furnace for the oxidative treatment of fibers having a processing chamber which can be found in the interior of a housing; at least one blowing device; at least one suction device; at least one ventilator that circulates the hot air through the blowing device, the processing chamber, and the suction device; and at least one heating device that lies in the flow path of the hot circulated air. Deviating rollers guide the fibers in a serpentine manner through the processing chamber such that the fibers lie next to one another as a carpet, the fiber carpet being stretched between each opposing deviating roller over one plane. The air in the processing chamber crosses the planes over which the fiber carpet is stretched at an angle that differs from 0° and 90° using special means.

7 Claims, 7 Drawing Sheets

OXIDATION FURNACE

RELATED APPLICATIONS

This application claims the filing benefit of International Patent Application No. PCT/EP2011/004108, filed Aug. 16, 2011, which claims the filing benefit of German Patent Application No. 10 2010 044 296.8 filed Sep. 3, 2010, the contents of both of which are incorporated herein by reference.

TECHNICAL FIELD AND BACKGROUND OF THE INVENTION

The invention relates to an oxidation furnace for the oxidative treatment of fibres, in particular for producing carbon fibres, having a) a housing, which is gas-tight with the exception of passage regions for the carbon fibres;
b) a process chamber located in the interior of the housing;
c) at least one blowing device by means of which hot air can be blown into the process chamber;
d) at least one suction device, which sucks hot air out of the process chamber;
e) at least one ventilator, which circulates the hot air through the blowing device, the process chamber and the suction device;
f) at least one heating device located in the flow path of the hot circulated air;
g) deflection rollers, which guide the fibres in serpentine manner through the process chamber such that they lie next to one another as a carpet,
wherein the fibre carpet stretches over a respective plane between opposing deflection rollers.

In known oxidation furnaces of this type, the different planes of the fibre carpet, which are located above one another, extend horizontally and lie parallel to the flow direction of the hot oxygen-containing air. As a result, the air flow is only involved in the heating and cooling of the fibres in its boundary layers, which are next to the fibre carpet. As a result of the parallel flow, a barrier forms at the surface of the fibres, which reduces the heat transfer. The core of the air flow is not involved in the heat transfer on account of the parallel flow. Substantial differences arise between the air entry and air exit temperature near to the fibres, which in turn leads to substantial temperature differences within the fibre carpet. The fundamental possibility of increasing the heat transfer by increasing the air speed is limited since the increasing movement of the fibres may cause them to become damaged, for example as a result of colliding with one another.

In an alternative construction of the known oxidation furnaces mentioned at the outset, the entire air flow is guided vertically through the different planes of the fibre carpet which are located above one another. This improves the heat transfer. However, the overall height is increased by the air supply system and air suction system.

SUMMARY OF THE INVENTION

An object of the present invention is to provide an oxidation furnace of the type mentioned at the outset, in which, with a low overall height, the heat transfer between the air and the fibres is improved and the temperature of the fibres in the process chamber is further homogenised.

This object may be achieved according to the invention in that h) means are provided, which ensure that the air in the process chamber crosses the planes over which the fibre carpet stretches at an angle which differs from 0° and 90°.

The resultant angled flow of the air relative to the planes of the fibre carpet results in improved temperature constancy since the fibre carpet is acted upon by the same temperature over the entire length between the blowing device and the suction device. This means better process control with a better process result. All of the circulated air is used for the heat absorption and heat supply; there are no air flows between the planes of the fibre carpet which are not involved. A lower volumetric flow rate is sufficient to achieve the same results. This not only saves on energy but also enables the oxidation furnace to be smaller in size.

In an advantageous embodiment of the invention, the means comprise at least two air deflectors. It is particularly favourable to have a plurality of air deflectors, which each extend in the clearances between the planar regions of the serpentine fibre carpet between the blowing device and the suction device. These air deflectors not only result in the desired direction of the air flow. They moreover act as radiation surfaces which contribute to heating the threads and dissipating the exothermic heat produced during oxidation. The temperature difference between the circulated air and the fibres is therefore reduced. At the same time, the air deflectors assume the function of fibre-guiding profiles, which were previously used to prevent fibres from coming into contact or entangling in the event of fibre breakage.

As a means for achieving the desired relative orientations of the air flow and fibre-carpet planes, it is alternatively or additionally possible to provide an additional airflow which has a vertical directional component and is superimposed on the first air flow extending between the blowing device and the suction device in the process chamber. In this embodiment of the invention, the angle at which the "effective" air flow produced by the superimposition crosses the planes over which the fibre carpet stretches can be controlled by the ratio of the flow speeds in the two flows; this implementation is therefore more variable in this respect than one which operates using air deflectors.

It is again alternatively or additionally possible for the said means to comprise deflection rollers which are tilted with respect to the vertical such that the planes over which the fibre carpet extending between them stretches are tilted with respect to the horizontal.

The concept according to the invention can be used both in situations where the main flow direction of the air is that of the longitudinal direction of the oxidation furnace between the inlet region and the outlet region and in situations where the main flow direction of the air is perpendicular to the longitudinal direction of the oxidation furnace. In the first case, the angle at which the air crosses the planes of the fibre carpet should be between 0.8° and 2°, preferably 1°, and in the second case it should be between 2° and 20°, preferably 4°.

It is to be understood that the aspects and objects of the present invention described above may be combinable and that other advantages and aspects of the present invention will become apparent upon reading the following description of the drawing and detailed description of the invention.

BRIEF DESCRIPTION OF THE DRAWINGS

Exemplary embodiments of the invention are explained in more detail below with reference to the drawings, which shows.

DETAILED DESCRIPTION OF THE PRESENT INVENTION

Figure 1:
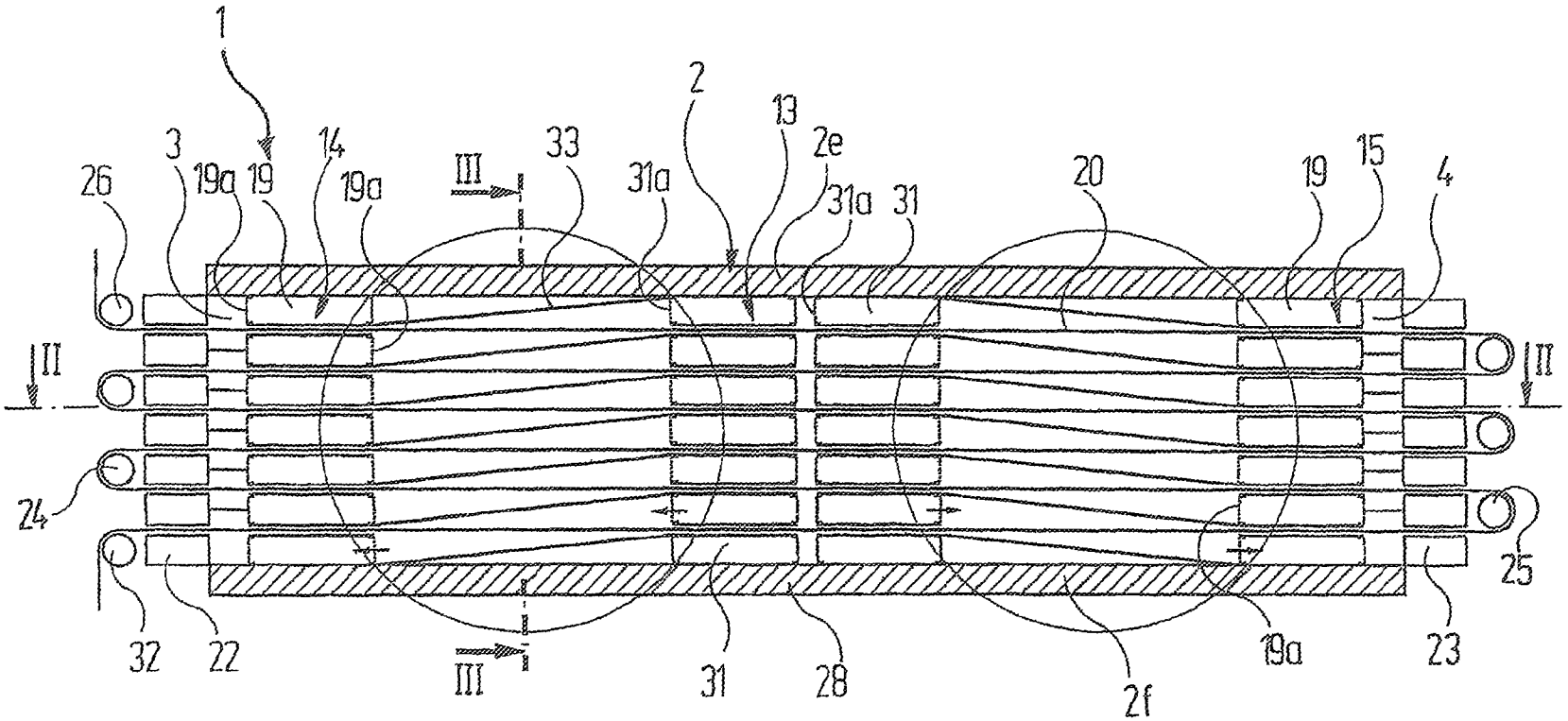
FIG. 1 a vertical section through an oxidation furnace for producing carbon fibres in the longitudinal direction of the furnace.

While this invention is susceptible of embodiment in many different forms, there is shown in the drawing and will herein be described in detail one or more embodiments with the understanding that the present disclosure is to be considered as an exemplification of the principles of the invention and is not intended to limit the invention to the embodiments illustrated.

Figure 2:
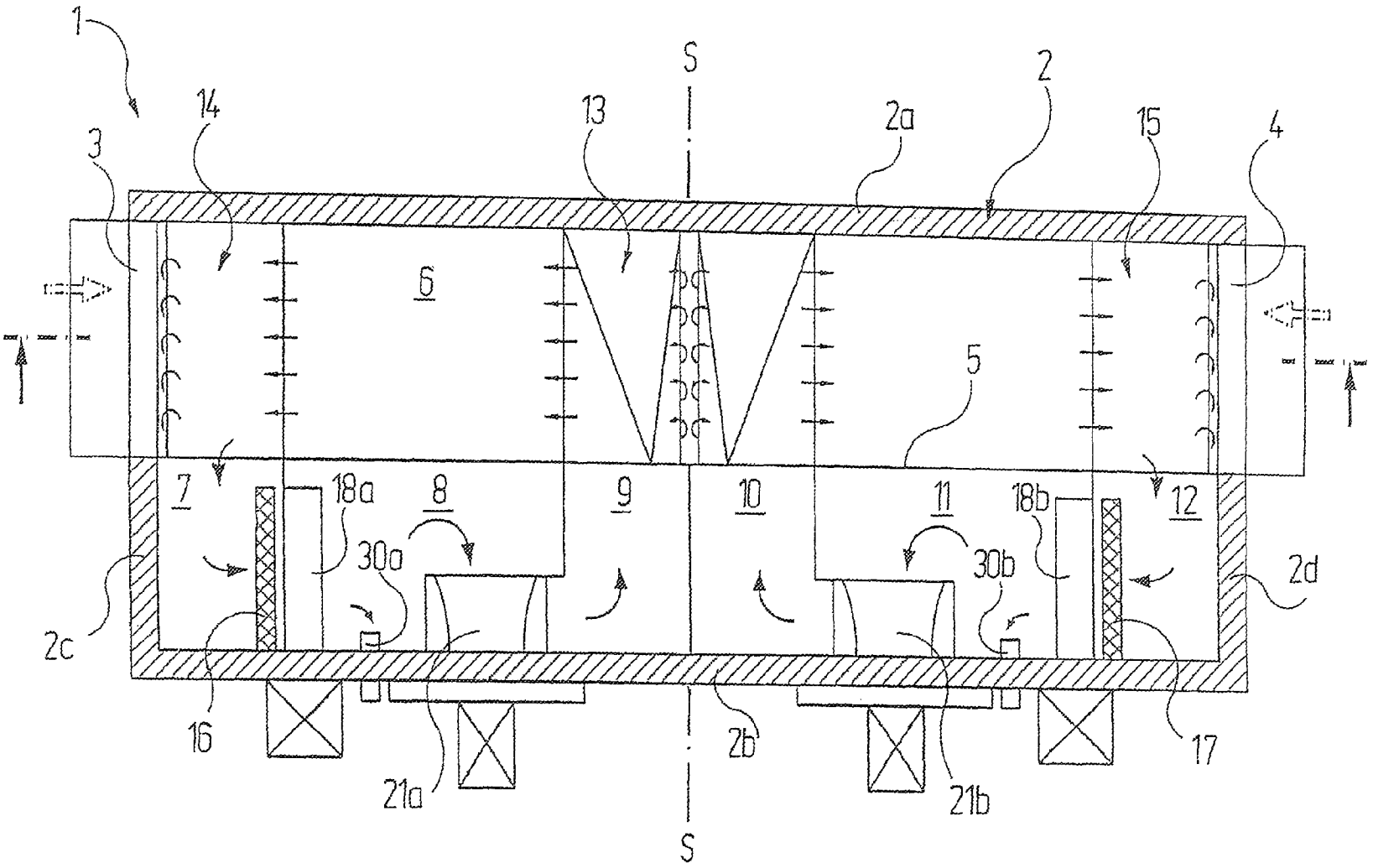
FIG. 2 a horizontal section through the oxidation furnace of FIG. 1 according to the line II-II therein (fibre carpet not shown)
Figure 3:
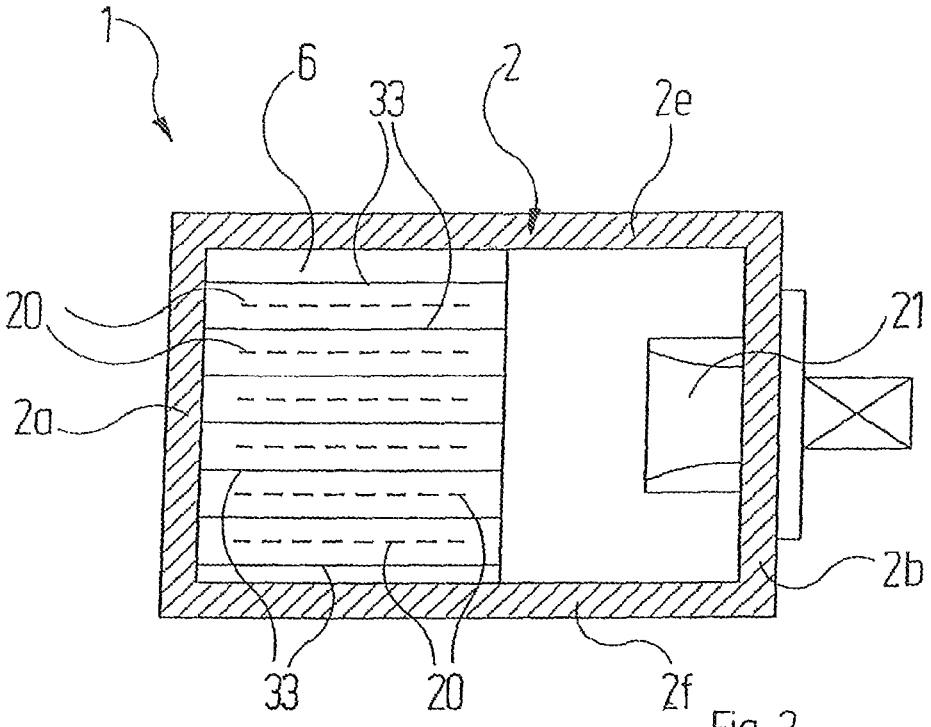
FIG. 3 a vertical section through the oxidation furnace of FIGS. 1 and 2 according to the line III-III of FIG. 1.

Reference is firstly made to FIGS. 1 to 3, which show a first exemplary embodiment of an oxidation furnace which is denoted as a whole by the reference numeral 1 and is used for producing carbon fibres. The oxidation furnace 1 comprises a housing 2 which is in turn composed of two vertical longitudinal walls 2*a*, 2*b*, two vertical end walls 2*c*, 2*d*, a top wall 2*e* and a bottom wall 2*f*. The housing is gas-tight with the exception of two regions 3, 4 in the end walls 2*c* and 2*d*, in which the fibres 20 to be treated are guided in and out and which are provided with special lock assemblies.

As shown in particular in FIG. 2, the interior of the housing 2 is divided by a vertical partition wall 5 into the actual process chamber 6 and air conducting chambers 7, 8, 9, 10, 11, 12 located at the side of the process chamber. All in all, the interior of the oxidation furnace 1 is constructed to be substantially mirror-symmetrical with respect to the central plane S-S indicated in FIG. 2.

Located in the central region of the process chamber 6, there is a blowing device which is provided as a whole with the reference numeral 13 and is explained in more detail below. Suction devices 14, 15 are located in the two outer end regions of the process chamber, respectively adjacent to the passage regions 3, 4.

Two directionally opposed air circuits are maintained in the interior of the housing 2: Starting for example from the suction devices 14, 15, the air is guided respectively in the direction of the arrows shown in FIG. 2 through the air conducting chambers 7 and 12 to a filter 16 and 17 and then through a heating unit 18*a* and 18*b* into the air conducting chamber 8 and 11. The heated air is sucked out of the air conducting chamber 8 and 11 by a ventilator 21*a* and 21*b* and blown into the air conducting chambers 9 and 10. From there, the air arrives respectively in one half of the blowing device 13, which is described more precisely below, flowing from there in opposite directions into the process chamber 6 and from there to the suction device 14 and 15 in a manner which is explained in more detail below, whereby the two air circuits are closed.

In the wall of the housing 2, two outlets 30*a*, 30*b* are provided in the region of the air conducting chambers 8, 11. By way of these outlets, it is possible to discharge those volumes of gas and air which are either produced during the oxidation process or arrive as fresh air into the process chamber 6 by way of the passage regions 3, 4 in order to maintain the air balance in the oxidation furnace 1. The discharged gases, which can also contain toxic constituents, are supplied for thermal afterburning. The heat obtained thereby can be used at least to preheat the fresh air supplied to the oxidation furnace 1.

The blowing device 13 is constructed in detail as follows:

It comprises two "stacks" of blowing boxes 31. Each of these blowing boxes 31 is in the shape of a hollow cuboid, with the longer dimension extending transversely to the longitudinal direction of the process chamber 6 over its entire width. The narrow sides of the blowing boxes 31, which face the process chamber 6 in each case, are constructed as perforated plates 31*a*. An exception to this is provided by the bottom-most blowing boxes 31, whereof the narrow side facing away from the centre of the oxidation furnace 1 in each case is closed for reasons which will become clear below.

A respective end face of each blowing box 31 is in communication with the air conducting chamber 9 and air conducting chamber 10 in such a way that the air delivered by the ventilator 21*a* and 21*b* is blown into the interior of the respective blowing box 31 and can exit from there by way of the perforated plates 31*a*.

The different blowing boxes 31 in each of the two stacks are arranged at a slight spacing above one another. The two stacks of blowing boxes 31 are in turn likewise spaced from one another, as seen in the longitudinal direction of the furnace or in the movement direction of the threads 20.

The two suction devices 14, 15 are formed substantially by a respective stack of suction boxes 19 which extend in similar manner to the blowing boxes 31 in the transverse direction through the entire process chamber 6 and are constructed as perforated plates 19*a* at their narrow sides extending transversely to the longitudinal extent of the process chamber 6. The narrow sides of the respective top-most suction box 19 in the stack provide an exception here for reasons which will become clear below.

Planar air deflectors 33 extend in each case between the upper edges of the outwardly facing narrow sides 31*a* of the blowing boxes 31 and the lower edges of the narrow sides of the suction boxes 19 which face the centre of the furnace.

The fibres 20 to be treated are supplied to the oxidation furnace 1, extending parallel as a type of "carpet", by way of a deflection roller 32 and pass through an air-supply device 22 here, which is not of interest in this connection and serves to supply the process with preheated fresh air. The fibres 20 are then guided through the clearances between suction boxes 19 lying above one another, through the process chamber 6, through the clearances between blowing boxes 31 lying above one another in the blowing device 13, through the clearance between suction boxes 19 lying above one another at opposite ends of the process chamber 6 and through a further air-supply device 23.

The outlined passage of the fibres 20 through the process chamber 6 is repeated a plurality of times in serpentine manner, for which a plurality of deflection rollers 24, 25 lying above one another with their axes parallel are provided in both end regions of the oxidation furnace 1. The fibre carpet 20 stretches over a respective plane between the deflection rollers 32, 25, 24, 26. After the uppermost passage through the process chamber 6, the fibres 20 exit the oxidation furnace 1 and are guided during this by way of a further deflection roller 26.

During the serpentine passage of the fibres 20 through the process chamber 6, these are surrounded by hot oxygen-containing air and thereby oxidised. This air passes in each case from the narrow sides 31*a* of the blowing boxes 31 into the clearance between two parallel air deflectors 33 and arrives in each case at a narrow side 19*a* of a suction box 19 which faces the centre of the furnace, and more precisely at that narrow side 19*a* of that suction box 19 which is one "level" lower than the blowing box 31.

The flow of hot oxygen-containing air which is produced in this way crosses the plane of the "fibre carpet" on this path, i.e. it is no longer precisely horizontal but has a vertical component of the flow direction. The barrier which occurs as a result of the parallel flow of air and fibres in oxidation furnaces of a known construction is thus prevented. Instead, the air flow penetrates the carpet of fibres 20 and also reaches the fibres 20 located in the interior of the fibre carpet 20. This results in a better heat transfer, especially to the fibres 20 located within the carpet, which in turn results in a shorter procedural treatment time, less of a temperature difference between the air temperature and fibre temperature, a homogenisation of the fibre temperature within the fibre carpet 20 and therefore ultimately an improved fibre quality.

As a result of the angled flow, the fibres 20 are moreover acted upon by air which comes directly from a blowing box 31 and therefore has substantially the same temperature over the entire length between the respective blowing box 31 and the associated suction box 19.

The air deflectors 33 have further functions: On the one hand, they serve as radiation surfaces when the threads are heated and, on the other, dissipate the exothermic heat produced during the oxidation of the fibres 20 by absorbing the thermal radiation. The temperature difference between the fibres 20 and the circulated air is thus reduced, which enables the process to be controlled more precisely.

Finally, the air deflectors 33 assume the function of guide profiles for the fibres. Separate guide profiles of this type were necessary in known oxidation furnaces. In the event of a fibre breaking, they prevent any contact and entanglement with other fibres. All broken fibres are collected by the air deflectors 33.

Figure 4:
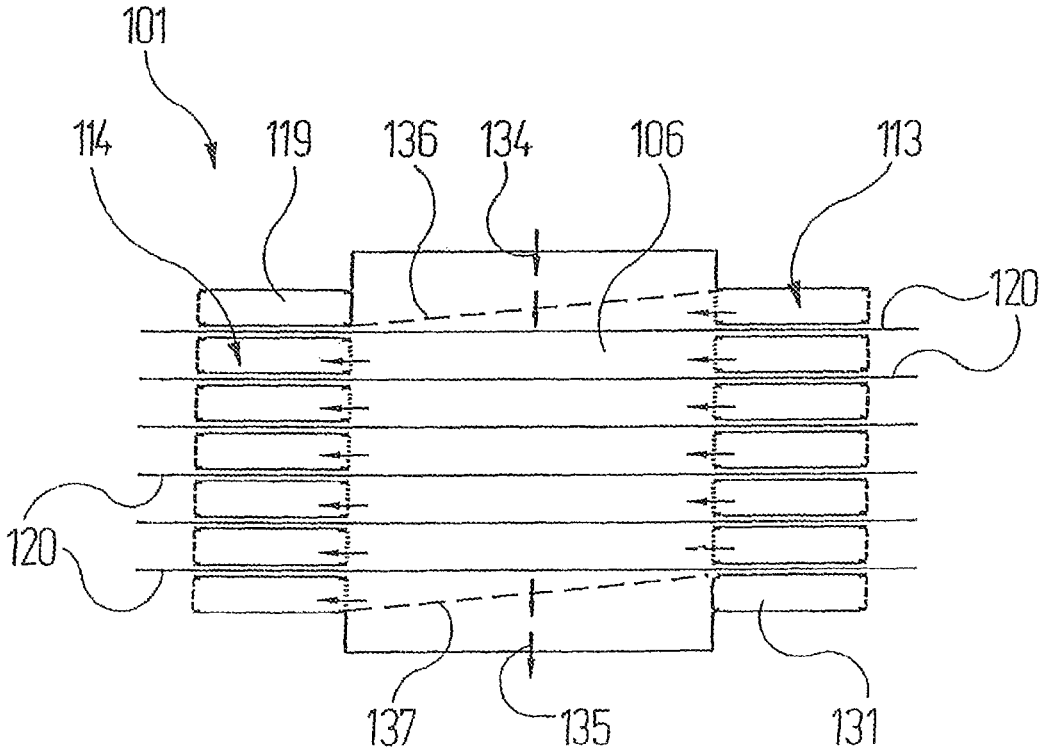
FIG. 4 the region which is shown circled on the left in FIG. 1 of a modified exemplary embodiment of an oxidation furnace.

FIG. 4 shows an alternative embodiment of that region of an oxidation furnace which is surrounded by a circle on the left in FIG. 1. Corresponding parts of this alternative embodiment are denoted by the same reference numerals as in FIG. 1, but increased by 100, and are not described in further detail. The same applies to the embodiments described below, in which the reference numerals are increased by 100 in each case from embodiment to embodiment.

In the exemplary embodiment of FIG. 4, the vertical component of the air flow is not achieved by air deflectors but by the additional superimposition of a vertical air flow. To this end, air is blown into the process chamber 106 in the direction of the arrows 134 and sucked out in the lower region of the process chamber 106 in the direction of the arrows 135. As it enters the process chamber 106 and exits the process chamber 106, the air can pass through perforated plates 136, 137 which are useful for generating an air flow which extends at an angle with respect to the horizontal.

Whilst, in the exemplary embodiments of an oxidation furnace 1 and 101 which are described above with the aid of FIGS. 1 to 4, the hot oxygen-containing air had a flow whereof the greater directional component pointed in the movement direction of the threads 20, this differs in the exemplary embodiments of the invention which are shown in FIGS. 7 to 10. The main flow direction of the air here is substantially transverse to the movement direction of the threads.

Figure 5:
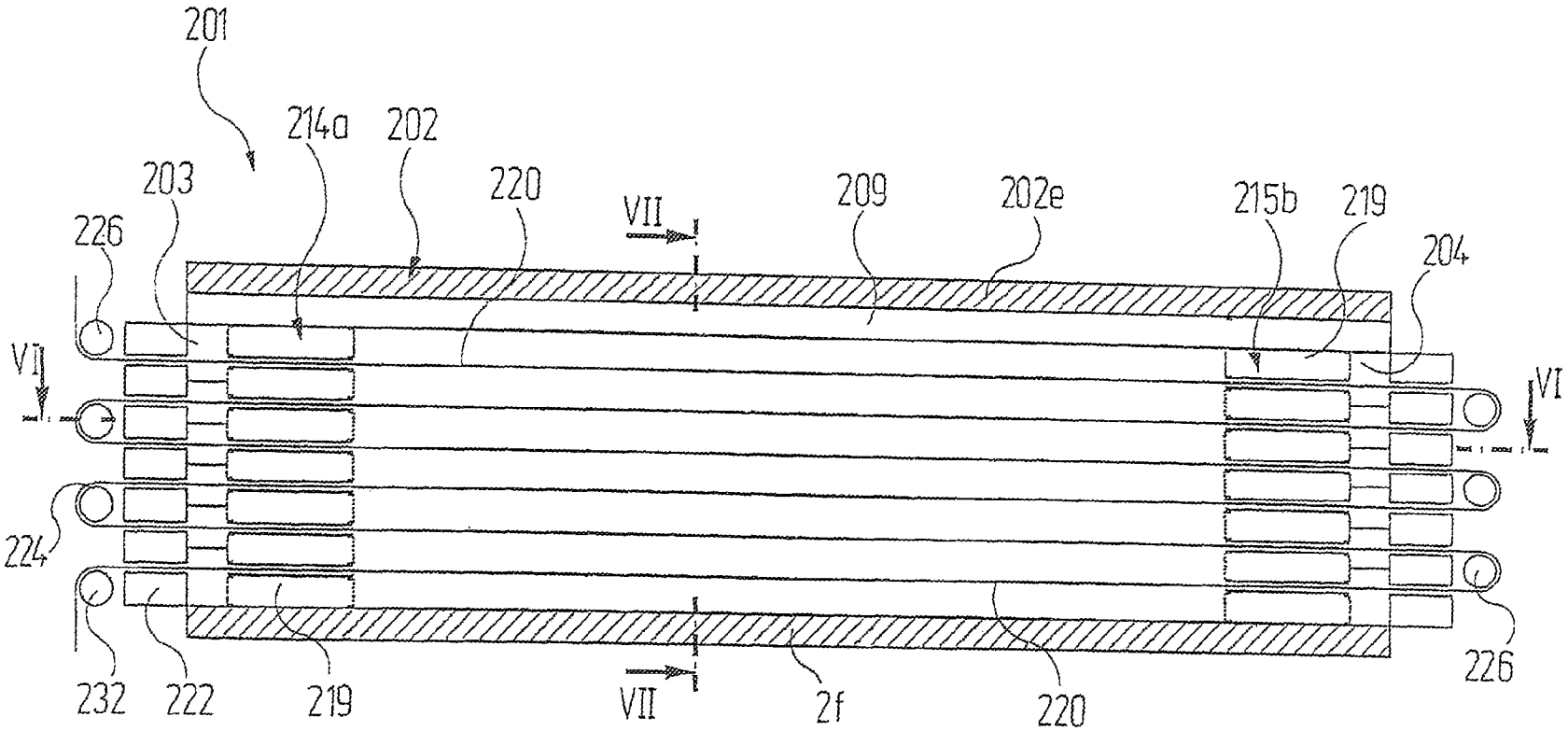
FIG. 5 a vertical section, similar to FIG. 1, through an oxidation furnace with a transverse air flow.
Figure 6:
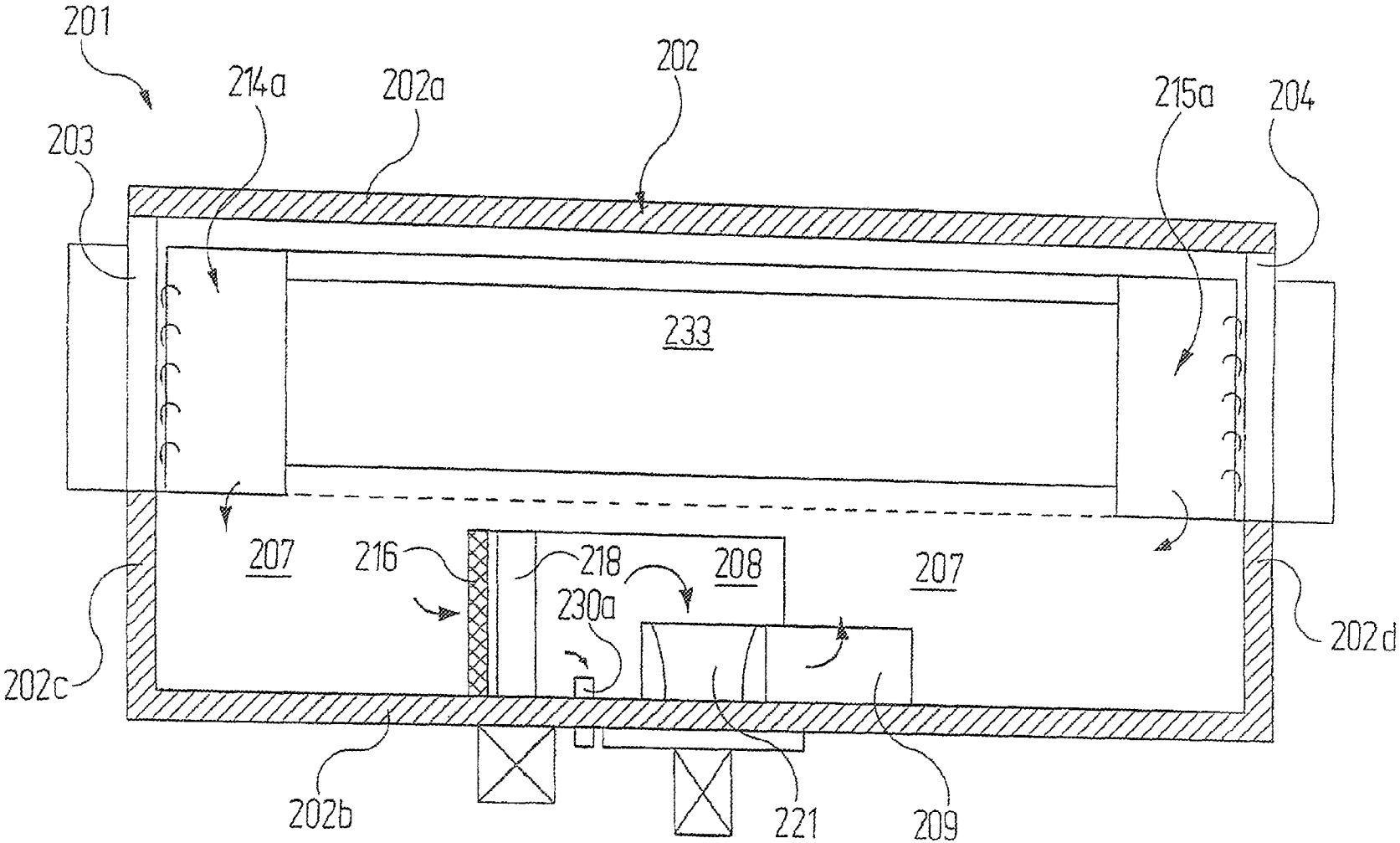
FIG. 6 a horizontal section through the oxidation furnace of FIG. 5 according to the line VI-VI therein (fibre carpet and deflection rollers not shown)
Figure 7:
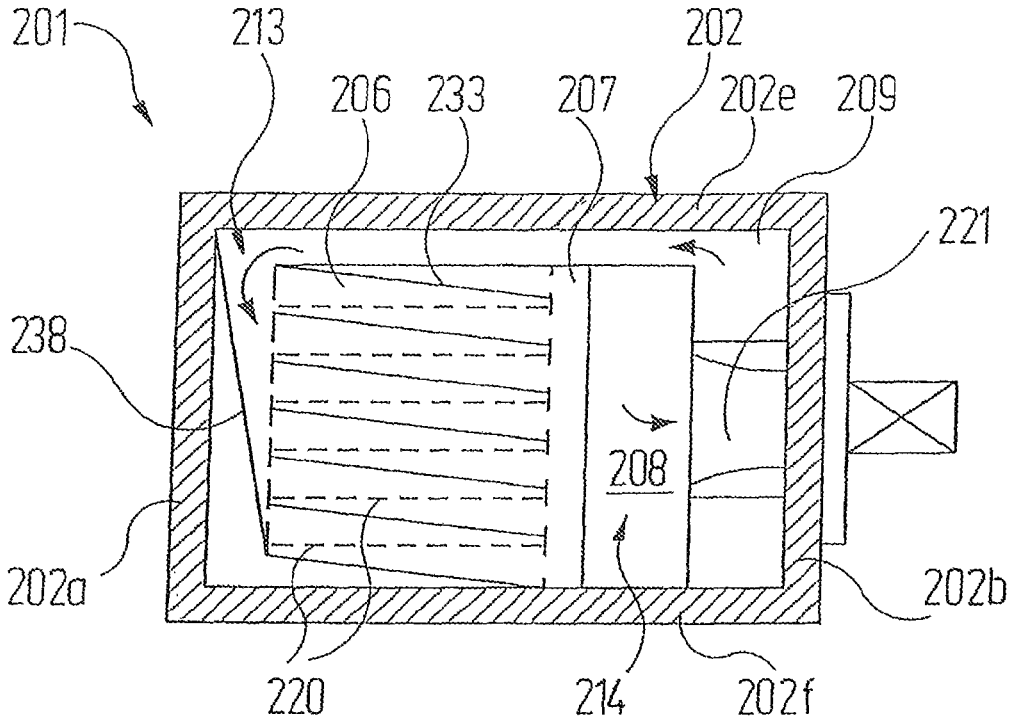
FIG. 7 a vertical section through the oxidation furnace of FIG. 5 according to the line VII-VII therein.

Reference is firstly made to FIGS. 5 to 7, which show a first exemplary embodiment of an oxidation furnace 201 which operates with a transverse air flow.

On comparing FIG. 5 with FIG. 1, it is firstly evident that the central blowing device 31 has been omitted in the exemplary embodiment of FIG. 5. This is a direct consequence of the fact that the main flow direction of the air does not extend in the longitudinal direction of the oxidation furnace 201 but in its transverse direction. If suction boxes 219 are nevertheless provided in both end regions of the housing 202, this serves to ensure that air which may contain toxic gases is prevented from escaping by way of the passage regions 203, 204.

The manner in which the flow of hot oxygen-containing air proceeds in the exemplary embodiment of FIG. 5 is most clearly revealed in FIGS. 6 and 7. To describe the air circuits, the suction device 214*a* is taken as a starting point and will be referred to as "auxiliary suction device" for reasons which shall become clear below. From this, the extracted air firstly arrives in the air conducting chamber 207 and mixes here with a further air flow as described further below. The unified air flows then pass through a filter 216 and a heating device 218, through which they arrive in the air conducting chamber 208. As with the exemplary embodiment of FIG. 1, some of the air can be discharged through an outlet 230*a*. A ventilator 221 sucks the air out of the air conducting chamber 208 and presses it into an air channel 209. This latter leads past the process chamber 206 to a lateral air distributing chamber 238 which tapers downwards in a wedge-shape and serves as a blowing device 213 here. The process chamber 206 is delimited at this side by a perforated plate so that the air guided into the air distributing chamber 238 can enter the process chamber 206.

The process chamber 206 is divided by a plurality of parallel air deflectors 233. Contrary to the air deflectors 33 of the exemplary embodiment of FIG. 1, these air deflectors 233 are not inclined in the longitudinal direction of the oxidation furnace 201 but in the transverse direction. As a result, the air entering the clearances between the air deflectors 233 by way of the air distributing chamber 238 is guided downwards at an angle, upon which it crosses the horizontal carpets of fibres 220 and thereby ensures a good heat transfer in a manner similar to that of the exemplary embodiment of FIG. 1. Otherwise the effects linked to the air guidance and the air deflectors 233 are the same as in the exemplary embodiment of FIG. 1.

At the opposite side, the clearances between the air deflectors 233 are in communication via a further perforated plate with the air conducting chamber 207, where the air mixes with the air coming from the auxiliary suction devices 214*a*, 215*a* as mentioned above. The air conducting chamber 207 in turn communicates as above with the suction side of the ventilator 221 so that the air conducting chamber 207 forms the "main suction device" 214 of this exemplary embodiment.

Figure 8:
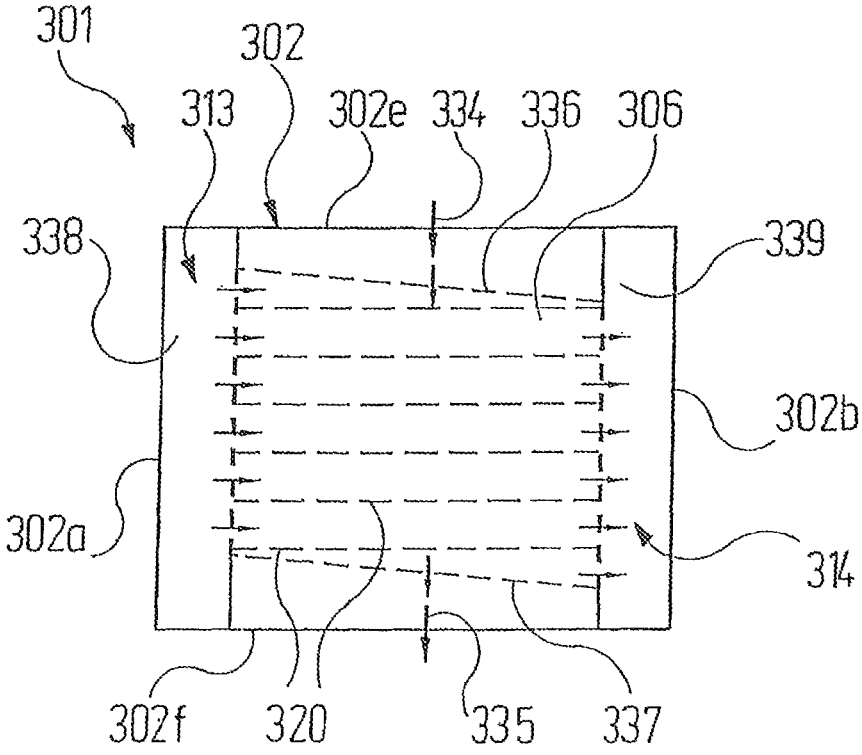
FIGS. 8 to 10 sections through alternative exemplary embodiments of an oxidation furnace, similar to FIG. 7, which are illustrated more schematically.

In the exemplary embodiment of an oxidation furnace 301 which is shown schematically in FIG. 8, angled air deflectors between the different serpentine portions of the fibre carpet 320 are dispensed with as in the exemplary embodiment of FIG. 4 and an additional air flow is used instead. This additional air is blown into the process chamber 306 from above in the direction of the arrows 334, passes through a perforated plate 336 here, crosses through a further perforated plate 337 at the lower end of the process chamber 306 and is then extracted in the direction of the arrows 335. By superimposing the air which is introduced from the air distributing chamber 338 (representing the blowing device 313) into the process chamber 306 and flows into the suction channel 339 (representing the main suction device 314) on the one hand and the second air flow, which is guided in the direction of the arrows 334, 335 through the process chamber 306, an angled air flow is produced which crosses the carpet of fires 320 with the advantages already mentioned several times above.

Figure 9:
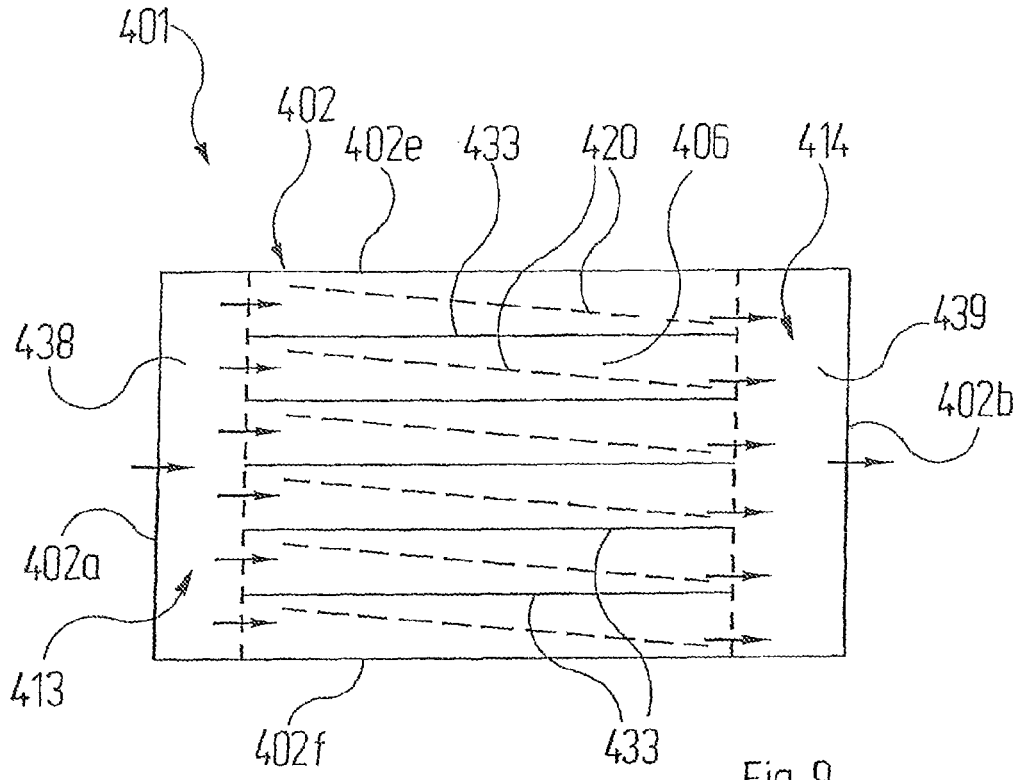

A further possibility for generating an air flow which does not flow against the carpet of fibres in a parallel or perpendicular direction is shown in FIG. 9. In the exemplary embodiment described here, air deflectors 433 are again used although they extend horizontally. It is the carpet of fibres 420 which is positioned at an angle here, and this can be achieved for example in that the different deflection rollers at the opposing passage regions of the oxidation furnace 401 are positioned accordingly at an angle.

Figure 10:
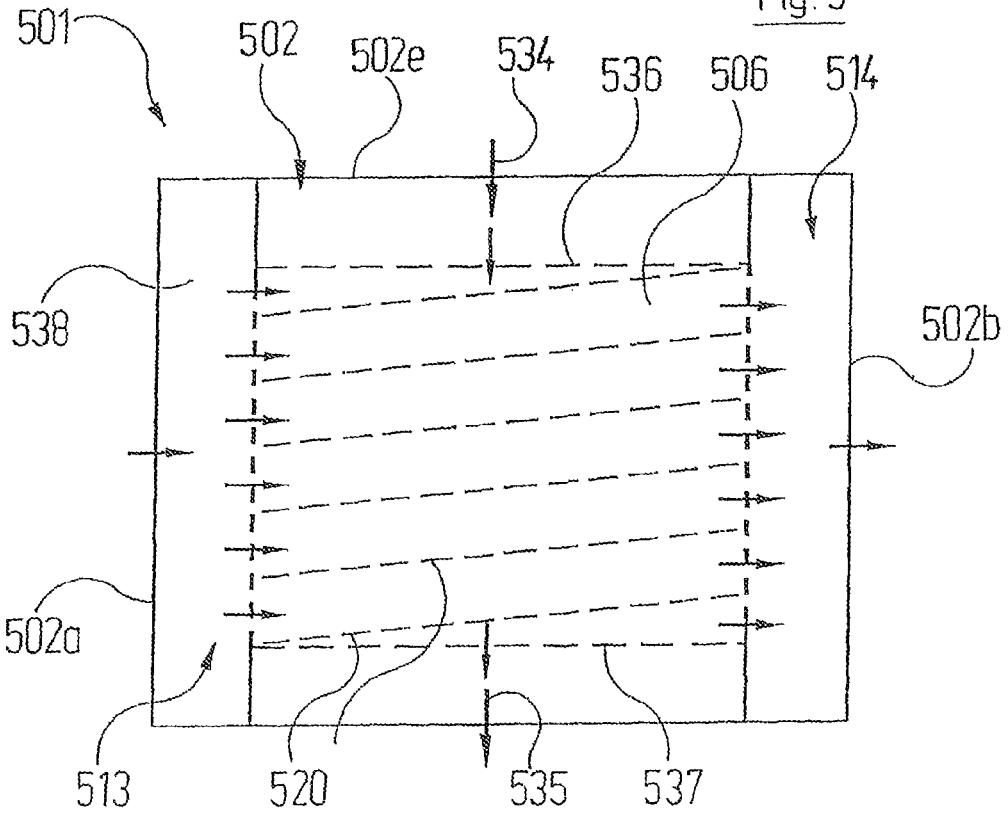

Finally, the exemplary embodiment of FIG. 10 in turn completely dispenses with air deflectors and replaces these with an additional air flow which is introduced from above into the process chamber 506 in the direction of the arrows 534, passes through a perforated plate 536 here, passes through the parallel, angled carpets of fibres 520 and is extracted by way of a further perforated plate 537 in the direction of the arrows 535. The results are similar to those of the exemplary embodiment of FIG. 8.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. An oxidation furnace for the oxidative treatment of fibres comprising:

a) a housing, which is gas-tight with the exception of passage regions for carbon fibres;

b) a process chamber located in an interior of the housing;

c) at least one blowing device by which hot air is blown into the process chamber;

d) at least one suction device, which sucks the hot air out of the process chamber;

e) at least one ventilator which circulates the hot air through the blowing device, the process chamber and the suction device;

f) at least one heating device located in a flow path of the hot air being circulated;

g) deflection rollers, which guide the carbon fibres in a serpentine manner through the process chamber such that the carbon fibers lie next to one another as a carpet, wherein the carpet stretches over a respective plane between opposing deflection rollers; and, wherein, h) means are provided, which ensure that the hot air in the process chamber crosses the plane, over which the carpet stretches, at an angle which deviates from 0° and from 90°; and i) wherein the means comprise at least two air deflectors; and j) wherein the air deflectors extend in each case in clearances between planar regions of the serpentine carpet between the blowing device and the suction device.

2. The oxidation furnace according to claim 1, wherein the means comprise an additional air flow which has a vertical directional component and is superimposed on a first air flow extending between the blowing device and the suction device in the process chamber.

3. The oxidation furnace according to claim 1, wherein the means comprise deflection rollers which are tilted with respect to the horizontal such that the planes over which the fibre carpet extending between them stretches are tilted with respect to the horizontal.

4. The oxidation furnace according to claim 1, wherein a main flow direction of the hot air is that of a longitudinal direction of the oxidation furnace between opposing passage regions.

5. The oxidation furnace according to claim 4, wherein the angle is between 0.8° and 3°.

6. The oxidation furnace according to claim 1, wherein a main flow direction of the air is perpendicular to a longitudinal direction of the oxidation furnace.

7. The oxidation furnace according to claim 6, wherein the angle is between 2° and 20°.

* * * * *